US009484173B2

(12) United States Patent
Naka et al.

(10) Patent No.: US 9,484,173 B2
(45) Date of Patent: Nov. 1, 2016

(54) ELECTROMAGNETIC SWITCH WITH INCREASED MAGNETIC FLUX DENSITY

(71) Applicants: FUJI ELECTRIC FA COMPONENTS & SYSTEMS CO., LTD., Chuo-ku, Tokyo (JP); FUJI ELECTRIC CO., LTD., Kawasaki-shi, Kanagawa (JP)

(72) Inventors: Yasuhiro Naka, Kounosu (JP); Kouetsu Takaya, Kounosu (JP); Kenji Suzuki, Kounosu (JP)

(73) Assignees: FUJI ELECTRIC FA COMPONENTS & SYSTEMS CO., LTD., Tokyo (JP); FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 14/677,047

(22) Filed: Apr. 2, 2015

(65) Prior Publication Data

US 2015/0213985 A1 Jul. 30, 2015

Related U.S. Application Data

(63) Continuation of application No. PCT/JP2013/005818, filed on Sep. 30, 2013.

(30) Foreign Application Priority Data

Nov. 13, 2012 (JP) ..... 2012-249546

(51) Int. Cl.
*H01H 3/00* (2006.01)
*H01H 50/64* (2006.01)
(Continued)

(52) U.S. Cl.
CPC ..... *H01H 50/648* (2013.01); *H01H 50/42* (2013.01); *H01H 50/20* (2013.01); *H01H 51/065* (2013.01); *H01H 2050/025* (2013.01); *H01H 2205/002* (2013.01)

(58) Field of Classification Search
CPC .... H01H 50/648; H01H 50/42; H01H 50/20; H01H 2050/025; H01H 51/065; H01H 2205/002; H01H 50/36; H01H 1/54; H01H 2001/545; H01H 50/546
See application file for complete search history.

(56) References Cited

U.S. PATENT DOCUMENTS 4,034,841 A 7/1977 Ohyama et al.
5,132,653 A * 7/1992 Nakatake ..... H01H 51/065 200/293

(Continued)

FOREIGN PATENT DOCUMENTS

| | | |
|---|---|---|
| CN | 1090424 | 8/1994 |
| EP | 2557582 A | 2/2013 |
| JP | S61-18556 U | 2/1986 |

OTHER PUBLICATIONS

PCT, "International Search Report for International Application No. PCT/JP2013/005818".

(Continued)

*Primary Examiner* — Bernard Rojas
(74) *Attorney, Agent, or Firm* — Manabu Kanesaka

(57) ABSTRACT

An electromagnetic switch includes a pair of fixed contacts fixed in a contact housing case with a predetermined distance therebetween; a movable contact disposed in the contact housing case to contact to and separate from the pair of fixed contacts; and an electromagnet unit causing the movable contact to contact to and separate from the pair of fixed contacts. The electromagnet unit has a magnetic yoke enclosing an exciting coil, a movable plunger disposed to move through a through hole provided in the magnetic yoke and having a contact pole surface facing the contact pole surface of the magnetic yoke, and a linking shaft linking the movable plunger and the movable contact. The contact pole surface of the movable plunger includes a circular protruding portion having a width narrower than that of a surface facing the magnetic yoke for increasing a magnetic flux density.

3 Claims, 9 Drawing Sheets

(51) Int. Cl.

| | |
|---|---|
| ***H01H 50/42*** | (2006.01) |
| *H01H 50/20* | (2006.01) |
| *H01H 51/06* | (2006.01) |
| *H01H 50/02* | (2006.01) |

(56) References Cited

U.S. PATENT DOCUMENTS

| | | | | |
|---|---|---|---|---|
| 5,638,041 | A | 6/1997 | Beyer et al. | |
| 5,959,519 | A * | 9/1999 | Gobel | H01F 7/1615 335/132 |
| 8,159,807 | B2 * | 4/2012 | Pohl | H01F 7/1615 361/160 |
| 2013/0092098 | A1 | 4/2013 | Dutcher et al. | |
| 2013/0127571 | A1 | 5/2013 | Takaya et al. | |

OTHER PUBLICATIONS

China Patent Office, "Office Action for Chinese Patent Application No. 201380052165.7," Apr. 15, 2016.

* cited by examiner

ELECTROMAGNETIC SWITCH WITH INCREASED MAGNETIC FLUX DENSITY

CROSS-REFERENCES TO RELATED APPLICATIONS

The present application is a Continuation Application of International Application No. PCT/JP2013/005818 filed Sep. 30, 2013, and claims priority from Japanese Application No. 2012-249546 filed Nov. 13, 2012.

TECHNICAL FIELD

The present invention relates to an electromagnetic switch having a pair of fixed contacts disposed keeping a predetermined distance from each other and a movable contact disposed so as to be capable of contacting to and separating from the fixed contacts. The electromagnetic switch increases a magnetic flux density between a circular protruding portion and a magnetic yoke.

BACKGROUND ART

As an electromagnetic switch which carries out switching of a current path, for example, an electromagnetic switch including a pair of fixed contacts each having a fixed contact point, the fixed contacts being spaced for a predetermined distance from each other, a movable contact having movable contact points at the left and right ends thereof, which is disposed so as to be capable of contacting to and separating from the pair of fixed contacts, and an electromagnet device, which drives the movable contact, is proposed, as described in PTL 1. The electromagnet device of the electromagnetic switch includes an open-topped U-section magnetic yoke, an upper magnetic yoke covering the open top of the magnetic yoke, a movable core which is moved up and down by an exciting coil, and a linking shaft which links the movable core and the movable contact through a through hole formed in the upper magnetic yoke.

CITATION LIST

Patent Literature

PTL 1: JP-A-2012-38684

SUMMARY OF INVENTION

Technical Problem

Meanwhile, in the heretofore known example described in PTL 1, the upper magnetic yoke and the movable core are configured so that the whole surface of the movable core forms a contact pole surface facing the contact pole surface of the upper magnetic yoke. Because of this, in a holding condition, a contact pole area S of the contact pole surfaces increases, and a magnetic flux density B thereby decreases.

Also, an attractive force F of an electromagnet unit is expressed by $$F \propto B^2 \cdot S \quad (1)$$

Consequently, in the heretofore known example, as the contact area of the upper magnetic yoke and movable core increases, and the magnetic flux density B thereby decreases, the attractive force F of the electromagnet unit decreases.

The decrease in the attractive force F means that a holding force decreases, and in order to suppress a contact portion load force, it is necessary to raise a holding current. However, there is an unsolved problem that it is disadvantageous in terms of power consumption and heat generation that the holding current is large.

Therefore, the invention, having been contrived in view of the heretofore described unsolved problem of the heretofore known example, has for its object to provide an electromagnetic switch wherein it is possible to suppress the contact portion load force without raising the holding current.

Solution to Problem

In order to achieve the heretofore described object, a first aspect of an electromagnetic switch according to the invention includes a pair of fixed contacts fixed in a contact housing case with a predetermined distance therebetween; a movable contact disposed in the contact housing case to be capable of contacting to and separating from the pair of fixed contacts; and an electromagnet unit causing the movable contact to contact to and separate from the pair of fixed contacts. Further, the electromagnet unit has a magnetic yoke enclosing an exciting coil, a movable plunger disposed to be movable through a through hole provided in the magnetic yoke and having a contact pole surface facing the contact pole surface of the magnetic yoke, and a linking shaft linking the movable plunger and the movable contact. Furthermore, the contact pole surface of the movable plunger includes a circular protruding portion having a width narrower than that of a surface facing the magnetic yoke for increasing a magnetic flux density.

Also, a second aspect of the electromagnetic switch according to the invention is such that the circular protruding portion is formed in an annular shape.

Also, in a third aspect of the electromagnetic switch according to the invention, the circular protruding portion is formed on an outer peripheral side of a peripheral flange portion formed on the movable plunger.

Advantageous Effects of Invention

According to the invention, as the circular protruding portion with a narrow width is formed on the contact pole surface of the movable plunger facing the contact pole surface of the magnetic yoke, it is possible to reduce the contact area of the contact pole surfaces of the movable plunger and magnetic yoke, and thus possible to increase the magnetic flux density between the circular protruding portion and the magnetic yoke and drastically improve the attractive force.

DESCRIPTION OF EMBODIMENTS

Figure 1:
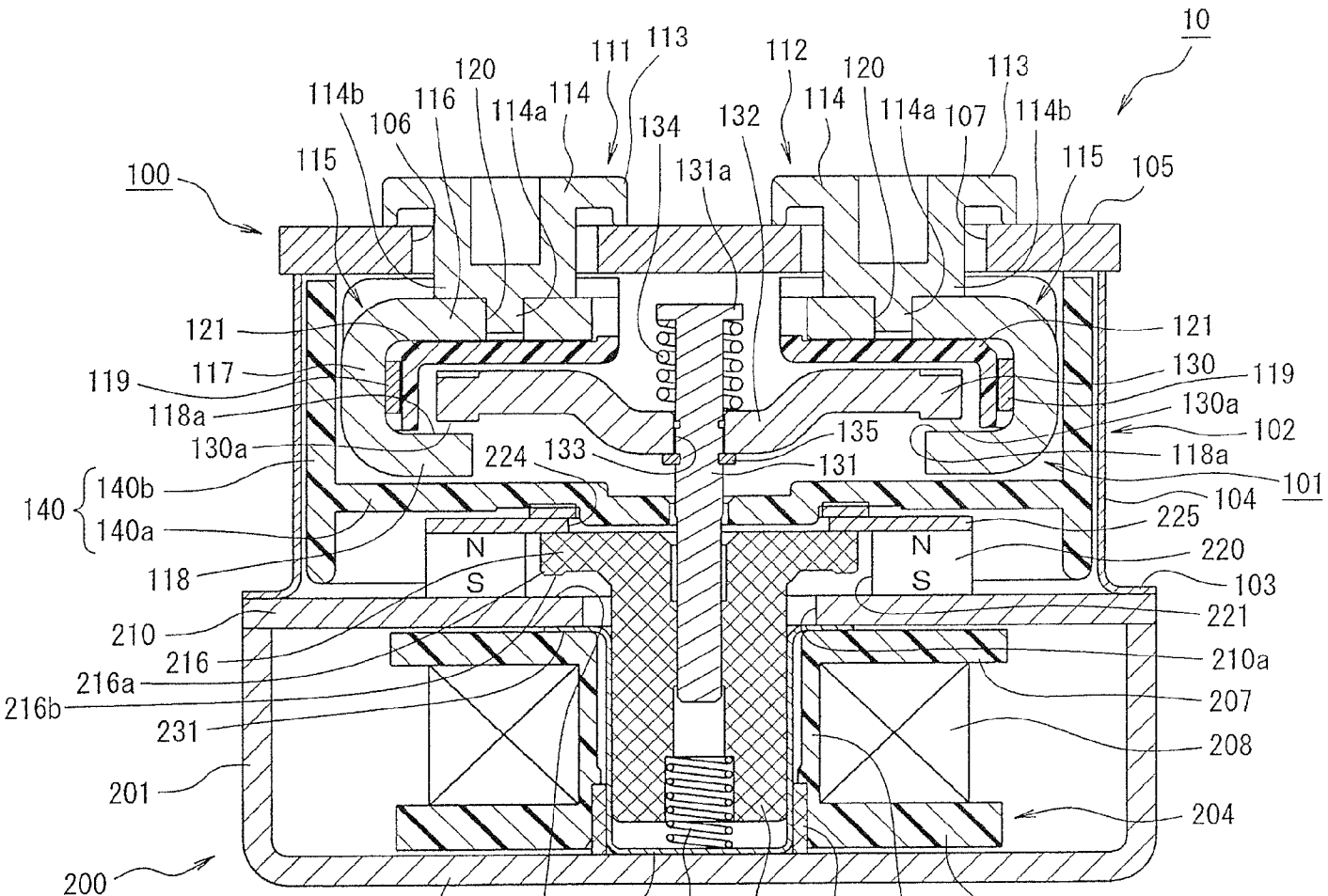
FIG. 1 is a sectional view showing a first embodiment of an electromagnetic switch according to the invention.

Hereafter, a description will be given, referring to the drawings, of an embodiment of the invention.

Figure 2:
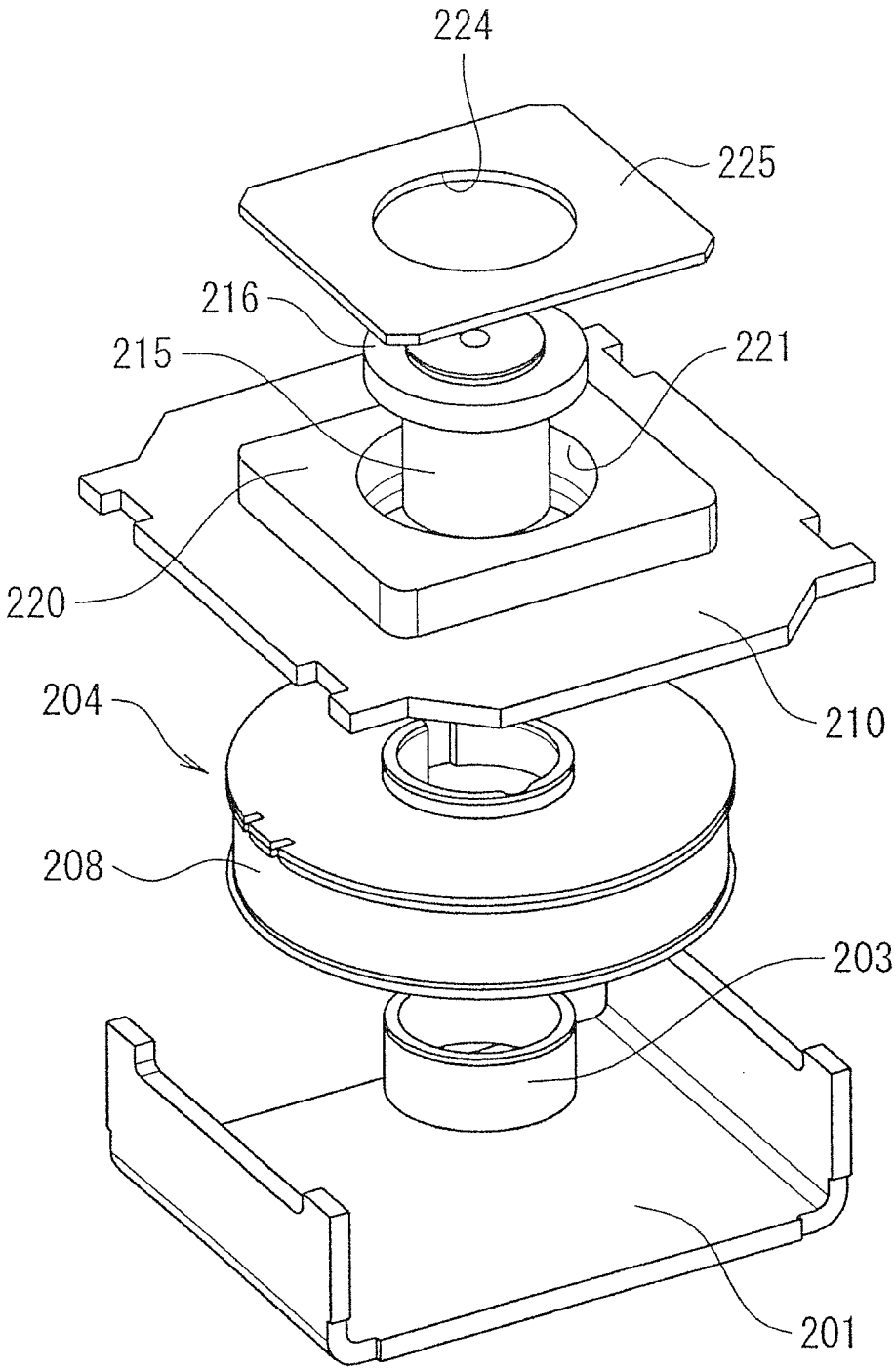
FIG. 2 is an exploded perspective view of an electromagnet unit.

FIG. 1 is a sectional view showing a first embodiment when an electromagnetic switch according to the invention is applied to an electromagnetic contactor, and FIG. 2 is an exploded perspective view of an electromagnet unit.

In FIGS. 1 and 2, reference 10 is an electromagnetic contactor, and the electromagnetic contactor 10 includes a contact device 100 in which a contact mechanism is disposed and an electromagnet unit 200 which drives the contact device 100.

The contact device 100, as is obvious from FIGS. 1 and 2, has a contact housing case 102, acting as an arc extinguishing chamber, which houses a contact mechanism 101. The contact housing case 102 includes a metal quadrangular cylindrical body 104, which has in the lower end portion thereof a metal flange portion 103 protruding outward, and a fixed contact support insulating substrate 105, forming a top plate, which includes a flat plate-like ceramic insulating substrate which closes the top of the metal quadrangular cylindrical body 104.

The metal quadrangular cylindrical body 104 is arranged such that the flange portion 103 thereof is fixed seal joined to an upper magnetic yoke 210 of the electromagnet unit 200, to be described hereafter.

Also, through holes 106 and 107 into which a pair of fixed contacts 111 and 112 is inserted, to be described hereafter, are formed in respective central portions of the fixed contact support insulating substrate 105 with a predetermined distance kept therebetween. Positions on the upper surface side of the fixed contact support insulating substrate 105 around the through holes 106 and 107, and a position on the lower surface side contacting the metal quadrangular cylindrical body 104, are metalized.

The contact mechanism 101, as shown in FIG. 1, includes the pair of fixed contacts 111 and 112 fixed to be inserted in the through holes 106 and 107 of the fixed contact support insulating substrate 105 of the contact housing case 102. Each of the fixed contacts 111 and 112 includes a support conductor portion 114, having at the upper end thereof a flange portion 113 protruding outward, which is inserted into each respective through hole 106 and 107 of the fixed contact support insulating substrate 105, and a C-shaped contact conductor portion 115, opening inward, which is linked to the support conductor portion 114 and disposed on the lower surface side of the fixed contact support insulating substrate 105.

The contact conductor portion 115 includes an upper plate portion 116 acting as a second linking plate portion, an intermediate plate portion 117 acting as a linking plate portion, and a lower plate portion 118 acting as a contact plate portion. The upper plate portion 116 extends outward along the lower surface of the fixed contact support insulating substrate 105. The intermediate plate portion 117 extends downward from the outer side end portion of the upper plate portion 116. The lower plate portion 118 extends parallel to the upper plate portion 116 and inward, that is, in a direction in which the fixed contacts 111 and 112 face each other, from the lower end side of the intermediate plate portion 117. Consequently, the contact conductor portion 115 is formed in a C-shape wherein the upper plate portion 116 is added to an L-shaped portion formed of the intermediate plate portion 117 and lower plate portion 118.

Herein, the support conductor portion 114 and the contact conductor portion 115 are fixed by, for example, brazing in a condition in which a pin 114*a* formed protruding from the lower end surface of the support conductor portion 114 is inserted in a through hole 120 formed in the upper plate portion 116 of the contact conductor portion 115. The fixation of the support conductor portion 114 and contact conductor portion 115 is not only carried out by brazing, but may also be carried out by fitting the pin 114*a* in the through hole 120, or by forming an external thread on the pin 114*a* and an internal thread on the through hole 120 and bringing the external and internal threads into threaded engagement with each other.

Also, a magnetic material plate 119 of a C-shape in plan view is mounted so as to cover the inner side surface of the intermediate plate portion 117 of the contact conductor portion 115 of each fixed contact 111 and 112. By the magnetic material plate 119 being disposed so as to cover the inner side surface of the intermediate plate portion 117 in this way, it is possible to shield a magnetic field generated by a current flowing through each intermediate plate portion 117.

The magnetic material plate 119 may be formed so as to cover the periphery of the intermediate plate portion 117, and only has to be able to shield the magnetic field generated by the current flowing through each intermediate plate portion 117.

Furthermore, an insulating cover 121, made of a synthetic resin material, which restrains arc commutation is mounted on each of the contact conductor portions 115 of the fixed contacts 111 and 112.

By mounting the insulating cover 121 on each of the contact conductor portions 115 of the fixed contacts 111 and 112 in this way, only the inner side upper surface side of the lower plate portion 118 is exposed from the inner peripheral surface of the contact conductor portion 115, thus forming a contact portion.

Further, the movable contact 130 is disposed so that two end portions thereof are positioned with one being inside each of the contact conductor portions 115 of the fixed contacts 111 and 112. The movable contact 130 is supported on a linking shaft 131 fixed in a movable plunger 215 of the electromagnet unit 200, to be described hereafter. The movable contact 130, as shown in FIG. 1, is arranged such that a depressed portion 132 wherein the vicinity of the linking shaft 131 in the central portion of the movable contact 130 protrudes downward is formed, and that a through hole 133 into which the linking shaft 131 is inserted is formed in the depressed portion 132.

The linking shaft 131 is formed at the upper end thereof with a flange portion 131*a* protruding outward. The movable contact 130 is held in position on the linking shaft 131. In order to hold the movable contact 130 in position, firstly, in a condition in which a contact spring 134 is inserted from the lower end side of the linking shaft 131, the linking shaft 131 is inserted into the through hole 133 of the movable contact 130. Next, by causing the movable contact 130 to ascend, the upper end of the contact spring 134 abuts against the flange portion 131*a*, and in a condition in which the contact spring 134 is contracted so as to obtain a predetermined urging force, the movable contact 130 is held in position by, for example, a C-ring 135.

In a release condition, the movable contact 130 attains a condition in which movable contact portions 130*a* at either end thereof and fixed contact portions 118*a* of the lower plate portions 118 of the contact conductor portions 115 of the fixed contacts 111 and 112 are separated keeping a predetermined distance from each other. Also, in a turn-on position, the movable contact 130 attains a condition in which the movable contact portions 130*a* at either end thereof contact the fixed contact portions 118*a* of the lower plate portions 118 of the contact conductor portions 115 of the fixed contacts 111 and 112 with a predetermined contact pressure of the contact spring 134.

Furthermore, an insulating cylindrical body 140 formed in a bottomed quadrangular cylindrical shape of a bottom plate portion 140*a* and a quadrangular cylindrical body 140*b* formed on the upper surface of the bottom plate portion 140*a* is disposed on the inner peripheral surface of the metal quadrangular cylindrical body 104 of the contact housing case 102, as shown in FIG. 1. The insulating cylindrical body 140, being made of, for example, a synthetic resin, is arranged such that the bottom plate portion 140*a* and the quadrangular cylindrical body 140*b* are integrally molded thereinto.

As shown in FIGS. 1 and 2, the electromagnet unit 200 has a magnetic yoke 201 of a flattened U-shape in side view, and a round cylindrical auxiliary yoke 203 is fixed to the central portion of a bottom plate portion 202 of the magnetic yoke 201. A spool 204 is disposed on the outer side of the round cylindrical auxiliary yoke 203.

The spool 204 includes a central round cylindrical portion 205 into which the round cylindrical auxiliary yoke 203 is inserted, a lower flange portion 206 protruding radially outward from the lower end portion of the central round cylindrical portion 205, and an upper flange portion 207 protruding radially outward from the upper end of the central round cylindrical portion 205. Further, an exciting coil 208 is wound in a housing space configured by the central round cylindrical portion 205, lower flange portion 206, and upper flange portion 207.

Figure 5:
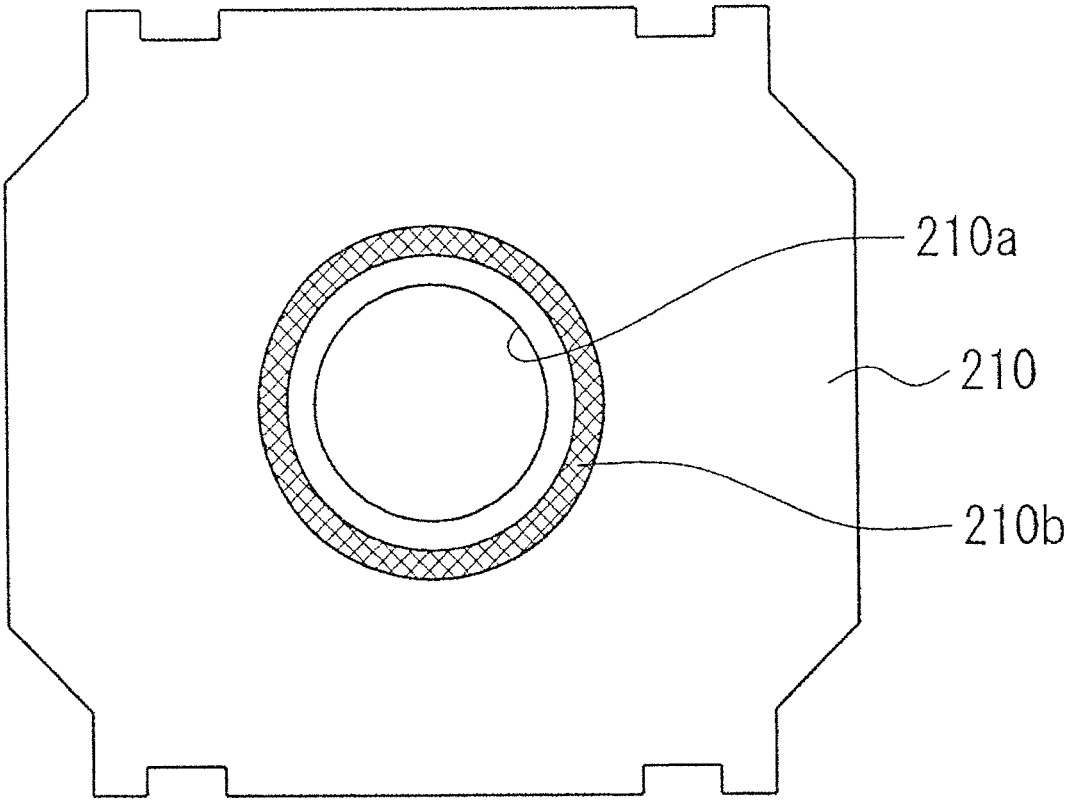
FIG. 5 is an illustration showing a contact pole surface of an upper magnetic yoke according to the invention.

Also, the upper magnetic yoke 210 is fixed between the upper ends, which form the open end, of the magnetic yoke 201. As shown in FIG. 5, the upper magnetic yoke 210 includes in the central portion thereof a through hole 210*a* facing the central round cylindrical portion 205 of the spool 204, and the upper surface side of the upper magnetic yoke 210 around the through hole 210*a* is formed as a contact pole surface 210*b*.

Further, the movable plunger 215 having disposed between the bottom portion thereof and the bottom plate portion 202 of the magnetic yoke 201 a return spring 214 is disposed in the central round cylindrical portion 205 of the spool 204 so as to be able to slide up and down.

Figure 3:
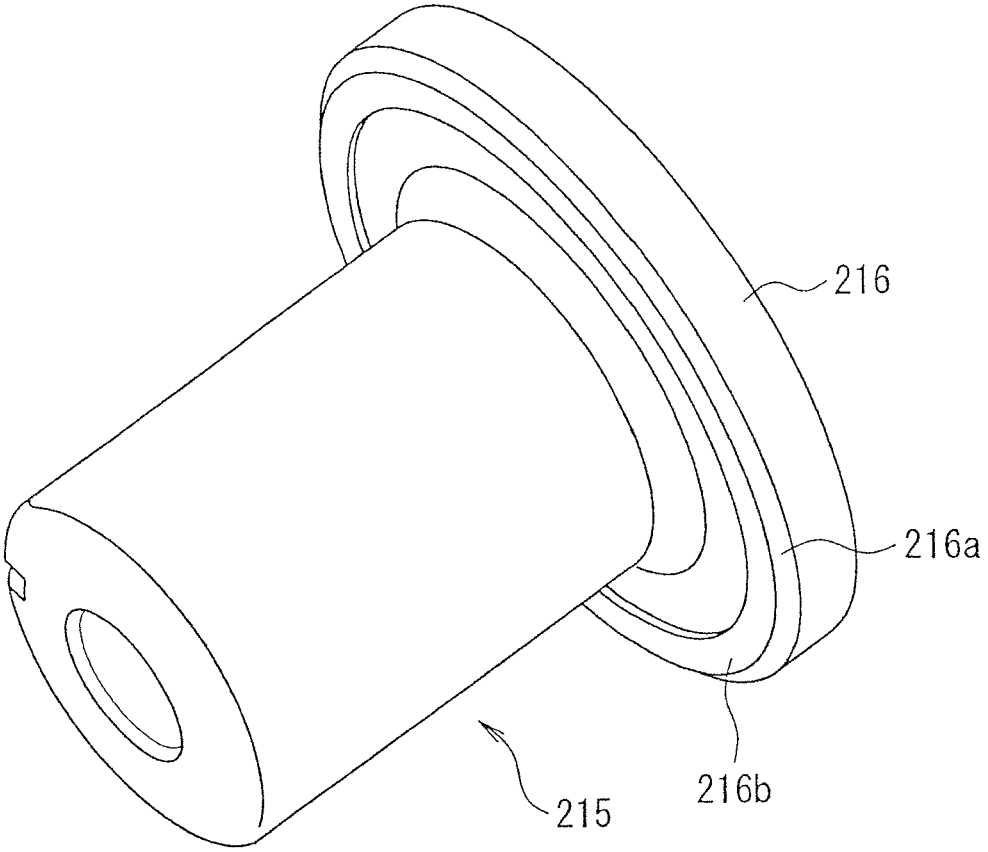
FIG. 3 is a perspective view showing a movable plunger.
Figure 4:
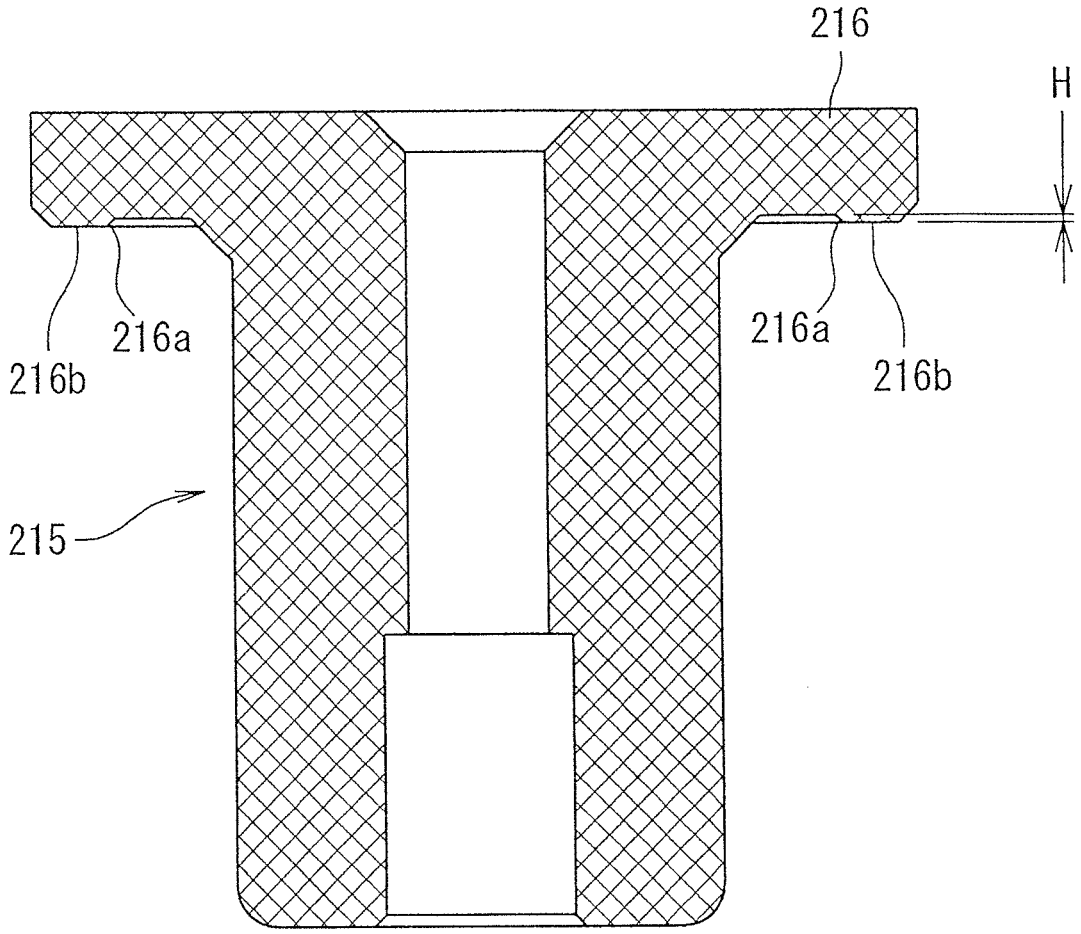
FIG. 4 is a sectional view of the movable plunger.

A peripheral flange portion 216 protruding radially outward is formed in an upper end portion of the movable plunger 215 protruding upward from the upper magnetic yoke 210. As shown in FIGS. 3 and 4, an annular protruding portion 216*a*, protruding downward, which has a height H of on the order of, for example, zero point several millimeters is formed on the outer peripheral side of the lower surface of the peripheral flange portion 216 facing the upper magnetic yoke 210. The lower surface of the annular protruding portion 216*a* is formed as a contact pole surface 216*b*.

Also, as shown in FIG. 5, the contact pole surface 210*b*, having a predetermined width, contacting the contact pole surface 216*b* of the movable plunger 215 is formed on the outer side of the periphery of the through hole 210 of the upper magnetic yoke 210.

In this way, the surface area of the contact pole surface 216*b* of the movable plunger 215 and the contact pole surface 210*b* of the upper magnetic yoke 210 with which the contact pole surface 216*b* contacts is set to be a small area which is within the width of the annular protruding portion 216*a*. Because of this, it is possible to enhance the magnetic flux density of magnetic fluxes heading from the contact pole surface 216*a* of the movable plunger 215 toward the contact pole surface 210*b* of the upper magnetic yoke 210 when the exciting coil 208 is excited, as will be described hereafter.

Further, as an attractive force F of the upper magnetic yoke 210 when the exciting coil 208 is excited is expressed by $F \propto B^2 \cdot S$ wherein the magnetic flux density of the contact pole surfaces is B, and the contact pole area is S, as in the previously described expression (1), an increase in the magnetic flux density B is as effective as the square of a decrease in the contact pole area S, meaning that it is possible to drastically increase the attractive force F. Consequently, it is possible to sufficiently secure the holding force of the upper magnetic yoke 210 holding the movable plunger 215.

Also, a circular permanent magnet 220, formed in a circular shape, whose external shape is, for example, quadrangular and which has a round central opening 221 is fixed to the upper surface of the upper magnetic yoke 210 so as to surround the peripheral flange portion 216 of the movable plunger 215. The circular permanent magnet 220 is magnetized with the upper end side as, for example, the N pole, and the lower end side as the S pole, in the up-down direction, that is, the thickness direction.

Further, an auxiliary yoke 225, having the same external shape as the circular permanent magnet 220, which has a through hole 224 of an inner diameter smaller than the outer diameter of the peripheral flange portion 216 of the movable plunger 215 is fixed to the upper end surface of the circular permanent magnet 220. The peripheral flange portion 216 of the movable plunger 215 abuts against the lower surface of the auxiliary yoke 225.

The shape of the circular permanent magnet 220, not being limited to the heretofore described, can also be formed in an annular shape, and the external shape thereof can, in sum, be formed in any shape, such as a round shape or a polygonal shape, as long as the inner peripheral surface of the circular permanent magnet 220 is of a shape matched to the shape of the peripheral flange portion 216.

Also, the linking shaft 131 which supports the movable contact 130 is screwed in the upper end surface of the movable plunger 215.

Further, the movable plunger 215 is covered with a cap 230, made of a non-magnetic material, which is formed in a bottomed cylindrical shape, and a flange portion 231 formed extending radially outward from the open end of the cap 230 is seal joined to the lower surface of the upper magnetic yoke 210.

By so doing, a hermetic container is formed wherein the contact housing case 102 and the cap 230 are caused to communicate with each other via the through hole 210*a* of the upper magnetic yoke 210. Further, a gas, such as a hydrogen gas, a nitrogen gas, a mixed gas of hydrogen and nitrogen, air, or $SF_6$, is sealed in the hermetic container formed of the contact housing case 102 and cap 230.

Next, a description will be given of an operation of the heretofore described embodiment.

Now, it is assumed that the fixed contact 111 is connected to, for example, a power supply source which supplies a large current, while the fixed contact 112 is connected to a load.

It is assumed, in this condition, that a release condition is attained wherein the exciting coil 208 in the electromagnet unit 200 is in a non-excited state, and no exciting force causing the movable plunger 215 to descend is generated in the electromagnet unit 200.

In the release condition, the movable plunger 215 is urged by the return spring 214 in an upward direction away from the upper magnetic yoke 210. At the same time as this, an attractive force generated by the magnetic force of the circular permanent magnet 220 is caused to act on the auxiliary yoke 225, and the peripheral flange portion 216 of the movable plunger 215 is attracted to the auxiliary yoke 225. Because of this, the upper surface of the peripheral flange portion 216 of the movable plunger 215 is in abutment with the lower surface of the auxiliary yoke 225.

Consequently, the movable contact portions 130*a* of the movable contact 130 of the contact mechanism 101 linked to the movable plunger 215 via the linking shaft 131 are separated for a predetermined distance upward from the fixed contact portions 118*a* of the fixed contacts 111 and 112. Because of this, a current path between the fixed contacts 111 and 112 is in an interrupted state, and the contact mechanism 101 attains an open condition.

In this way, in the release condition, both the urging force of the return spring 214 and the attractive force of the circular permanent magnet 220 act on the movable plunger 215, so that the movable plunger 215 does not descend inadvertently due to external vibration, impact, or the like, and it is thus possible to reliably prevent a malfunction.

In order to supply power to the load in the release condition, magnetic paths through which the exciting coil 208 of the electromagnet unit 200 is excited to generate an exciting force in the electromagnet unit 200 are formed. The magnetic paths are formed so as to pass from the movable plunger 215 through the peripheral flange portion 216, from the contact pole surface 216*b* on the lower surface of the annular protruding portion 216*a* formed on the lower surface of the peripheral flange portion 216 through the contact pole surface 210*b* of the upper magnetic yoke 210, and furthermore, pass from the left and right end portions of the upper magnetic yoke 210 through the magnetic yoke 201, and through the auxiliary yoke 203 to the movable plunger 215.

Due to the magnetic paths, an attractive force is generated between the contact pole surface 216*b* of the movable plunger 215 and the contact pole surface 210*b* of the upper magnetic yoke 210, which face each other, and the movable plunger 215 is attracted by the upper magnetic yoke 210. Because of this, the movable plunger 215 is caused to descend against the urging force of the return spring 214 and the attractive force of the circular permanent magnet 220. The descent of the movable plunger 215 is stopped by the lower surface of the peripheral flange portion 216 abuting the upper surface of the upper magnetic yoke 210.

Further, by the movable plunger 215 descending, the movable contact 130 linked to the movable plunger 215 via the linking shaft 131 also descends, and the movable contact portions 130*a* of the movable contact 130 contact the fixed contact portions 118*a* of the fixed contacts 111 and 112 with the contact pressure of the contact spring 134.

Because of this, a closed condition is attained wherein the large current of the external power supply source is supplied to the load through a main circuit including the fixed contact 111, movable contact 130, and fixed contact 112.

At this time, as the contact pole surface 216*b* of the movable plunger 215 is formed on the lower surface of the annular protruding portion 216*a*, the contact pole area S decreases, but the magnetic flux density B increases, and it is thus possible to increase the attractive force F in accordance with the previously described expression (1). Because of this, the upper magnetic yoke 210 can hold the movable plunger 215 with a sufficient holding force when in the closed condition in which the movable contact 130 is contacting the fixed contacts 111 and 112.

Figure 6:
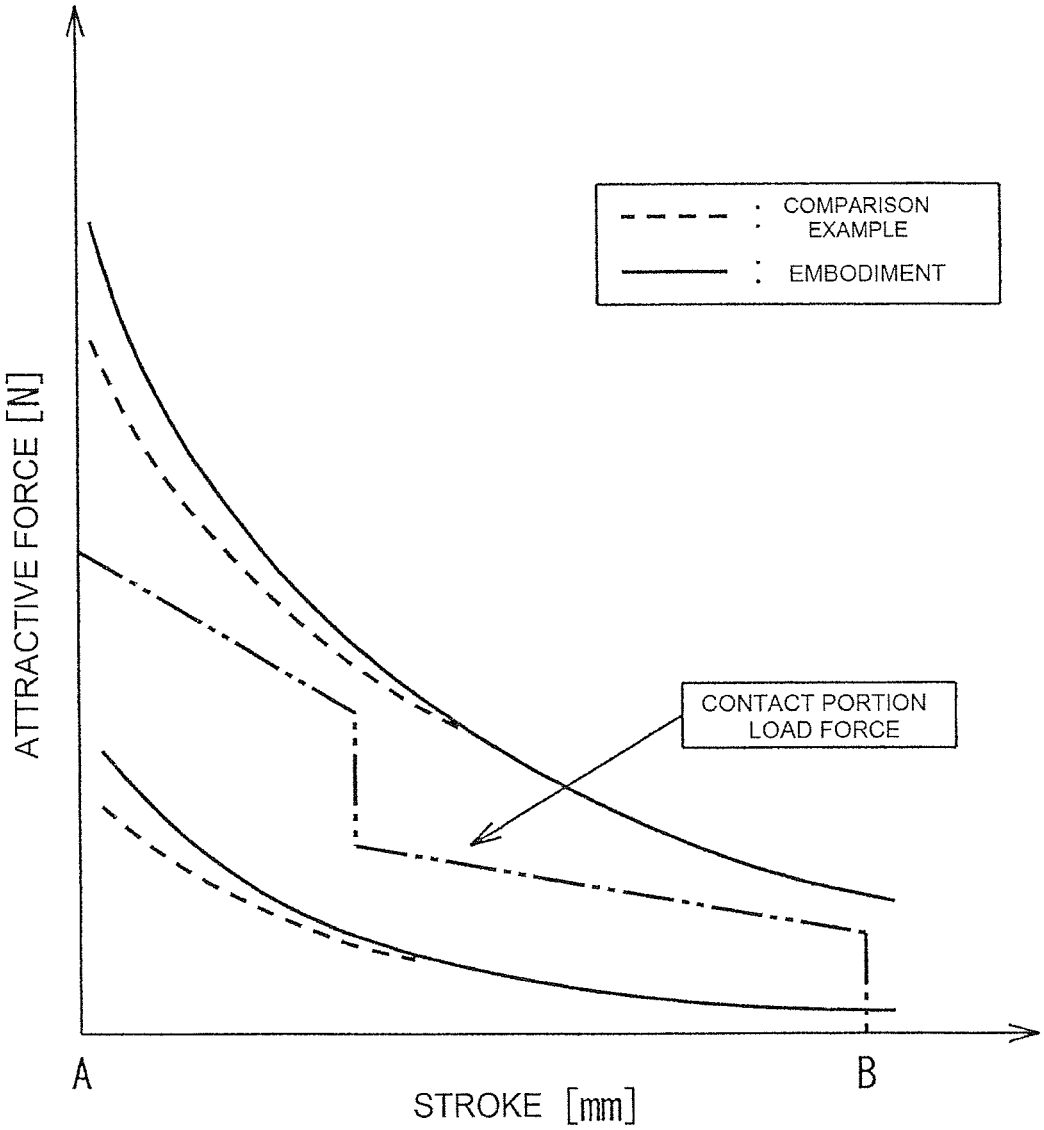
FIG. 6 is a characteristic diagram showing a relationship between a stroke and an attractive force.

In this way, by setting the contact pole area in the holding condition to be small, it is possible to enhance the magnetic flux density on this contact pole surface, and it is possible to increase the attractive force (holding force) at an A point when in the closed condition in which the stroke of the movable plunger 215 is in the vicinity of "0", as shown by the solid lines in FIG. 6. At this time, there is no need to increase the holding current of the exciting coil 208 in order to suppress the contact portion load force shown by the two-dot chain line, and it is possible to secure a reliable holding force by suppressing an increase in power consumption and an increase in heat generation.

Figure 7:
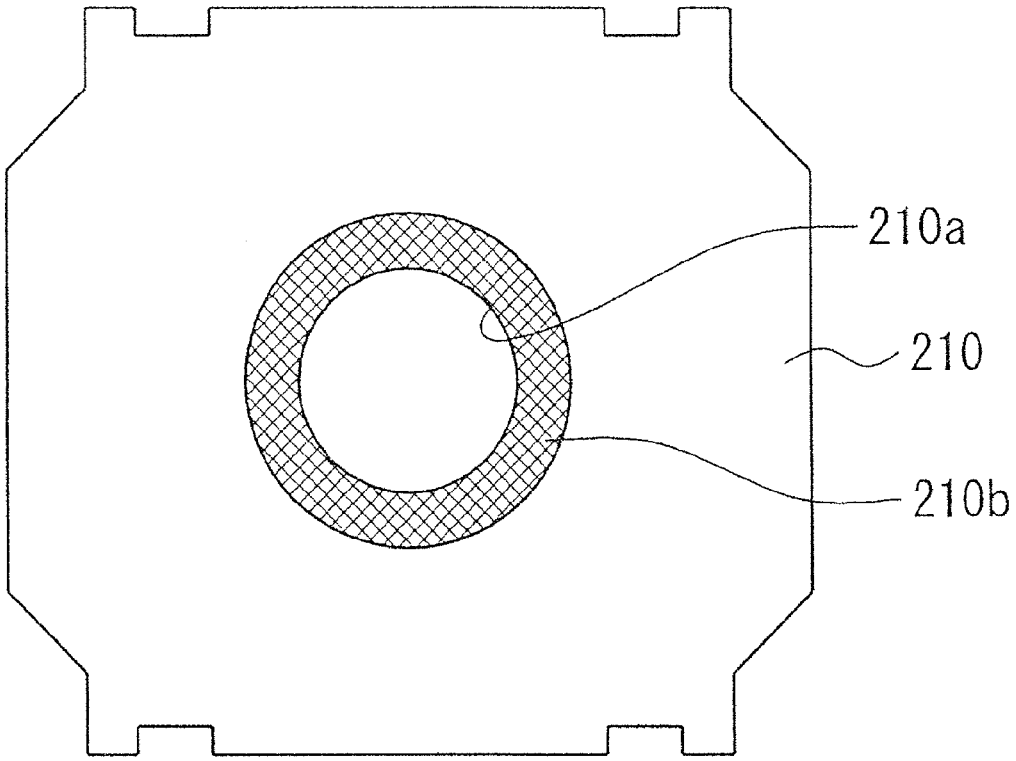
FIG. 7 is a plan view showing a contact pole surface of an upper magnetic yoke of a comparison example.

Incidentally, in the case of a comparison example wherein the annular protruding portion 216*a* is not provided on the lower surface of the peripheral flange portion 216 of the movable plunger 215, the wide area of the lower surface of the peripheral flange portion 216 forms a contact pole surface. Because of this, the contact pole surface 210*b* of the upper magnetic yoke 210, as shown in FIG. 7, expands as far as the edge of the through hole 210*a*, and the contact pole area S increases, but the magnetic flux density B decreases by an amount equivalent thereto.

Consequently, in the case of the comparison example, the attractive force F of the upper magnetic yoke 210 decreases, and the attractive force at the A point when in the closed condition decreases compared with in the embodiment, as shown by the dashed lines in FIG. 6.

Because of this, in order to secure a reliable holding force in the comparison example, it is necessary to increase the holding current of the exciting coil 208 in order to suppress the contact portion load force shown by the two-dot chain line, and there arises a problem that power consumption increases and heat generation also increases.

According to the embodiment, however, the contact pole area S is reduced, and the magnetic flux density B is increased, by the lower surface of the annular protruding portion 216*a*, having a narrow width, which is formed on the lower surface of the movable plunger 215, being made the contact pole surface 216*b*, as heretofore described. Because of this, as it is possible to increase the attractive force of the upper magnetic yoke 210 attracting the movable plunger 215, it is possible to solve the heretofore described problem.

In this way, according to the heretofore described embodiment, as the annular protruding portion 216*a*, the contact pole area of which is made smaller than all the surface area of the peripheral flange portion 216, is formed on the lower surface of the peripheral flange portion 216 of the movable plunger 215, it is possible to reduce the contact pole area of the annular protruding portion 216*a* and upper magnetic yoke 210, and increase the magnetic flux density by an amount equivalent thereto.

As a result of this, it is possible to increase the attractive force F of the upper magnetic yoke 210 in accordance with the previously described expression (1). Moreover, as there is no need to increase the holding current of the exciting coil

208 in order to increase the attractive force, it is possible to reliably prevent an increase in power consumption and an increase in heat generation.

In the heretofore described embodiment, a description has been given of a case in which the movable plunger 215 is formed in a round cylindrical shape, and the peripheral flange 216 is formed in a disk shape, but the invention is not limited to this. That is, the external shape of the peripheral flange portion 216 can be formed in a polygonal shape, such as a quadrangular shape, a pentagonal shape, or a hexagonal shape, and the annular protruding portion 216*a* can also be formed in any polygonal cylindrical shape in accordance with the external shape of the peripheral flange portion 216, and in sum, only has to be a circular raised portion. Also, the shape of the movable plunger 215, also not being limited to a round cylindrical shape, can be formed in any polygonal cylindrical shape. The shape of the through hole 210*a* of the upper magnetic yoke 210 only has to be changed in accordance with the shape of the movable plunger 215.

Also, in the heretofore described embodiment, a description has been given of a case in which the contact housing case 102 is formed by brazing the metal quadrangular cylindrical body 104 and the fixed contact support insulating substrate 105 which closes the top of the metal quadrangular cylindrical body 104, but the invention is not limited to this. That is, the contact housing case 102 may be integrally formed in a tub-like shape from an insulating material, such as ceramics or a synthetic resin material.

Figure 8A:
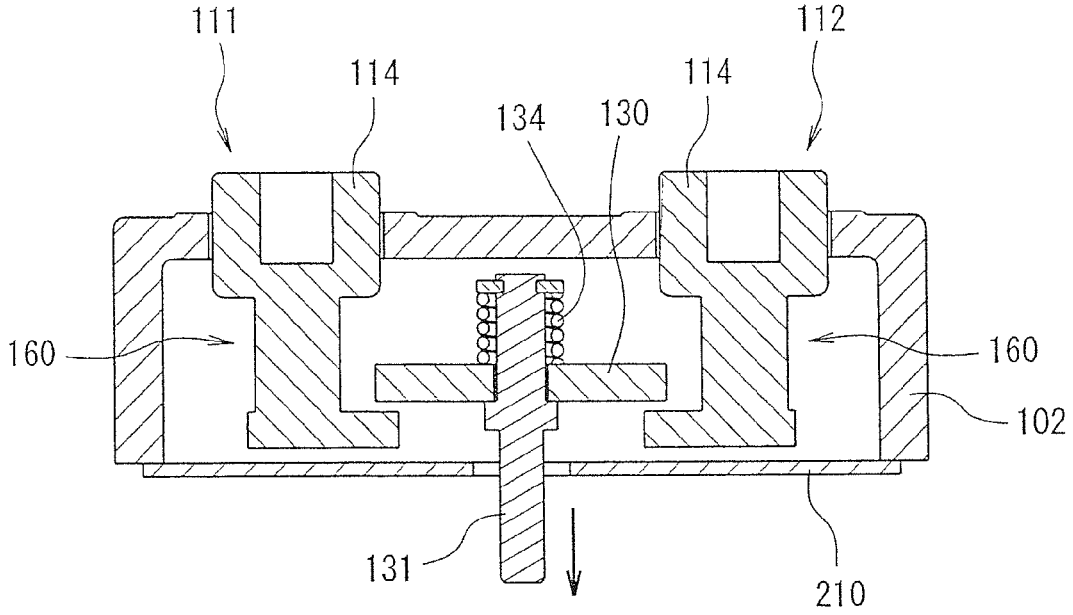
FIGS. 8(*a*), 8(*b*) are diagrams showing a modification example of a contact device of the invention, wherein FIG. 8(*a*) is a sectional view, and FIG. 8(*b*) is a perspective view.
Figure 8B:
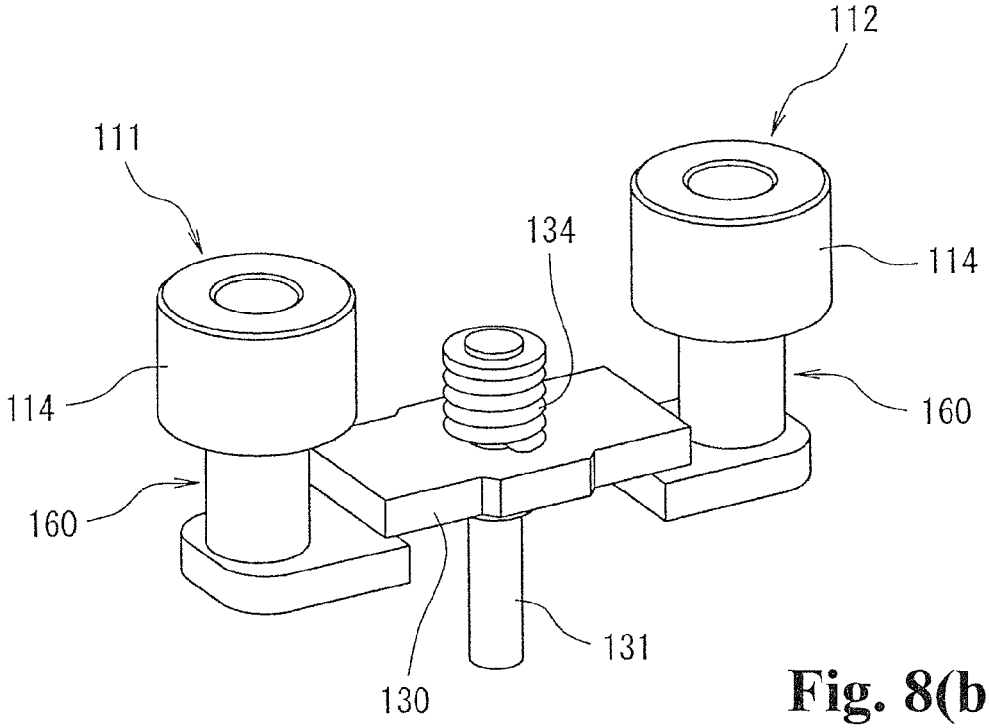

Also, in the heretofore described embodiment, a description has been given of a case in which the C-shaped contact conductor portion 115 is formed in each fixed contact 111 and 112, but the invention not being limited to this, an L-shaped portion 160 having a shape such that the upper plate portion 116 is omitted from the contact conductor portion 115 may be linked to each support conductor portion 114, as shown in FIGS. 8(*a*), 8(*b*).

Figure 9A:
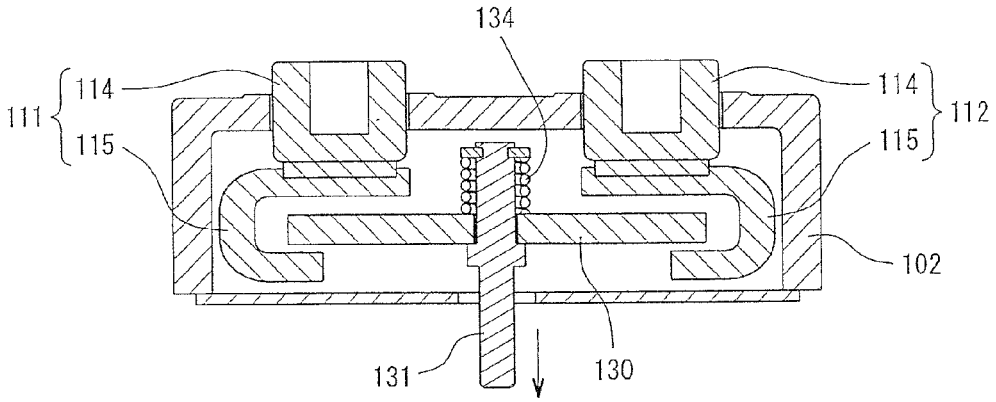
FIGS. 9(*a*), 9(*b*) are diagrams showing another modification example of the contact device of the invention, wherein FIG. 9(*a*) is a sectional view, and FIG. 9(*b*) is a perspective view.
Figure 9B:
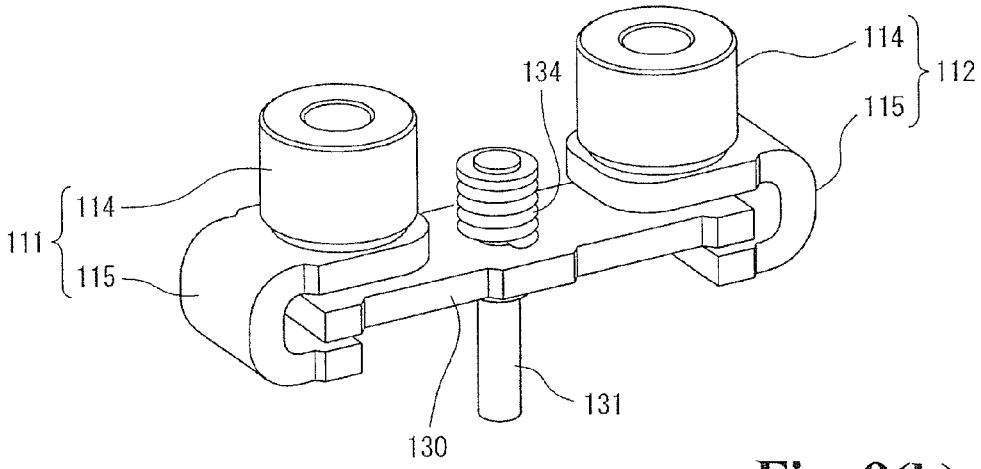

Also, in the heretofore described embodiment, a description has been given of a case in which the movable contact 130 has in the central portion thereof the depressed portion 132, but the invention not being limited to this, the movable contact 130 may be formed in a flat plate-like shape by omitting the depressed portion 132, as shown in FIGS. 9(*a*), 9(*b*). In sum, the configuration of the contact mechanism 101 can be of any configuration.

Also, in the heretofore described embodiment, a description has been given of a case in which the linking shaft 131 is screwed in the movable plunger 215, but the movable plunger 215 and the linking shaft 131 may be integrally formed.

Also, a description has been given of a case in which the linking of the linking shaft 131 and movable contact 130 is arranged such that the flange portion 131*a* is formed at the leading end portion of the linking shaft 131, and after the linking shaft 131 is inserted into the contact spring 134 and movable contact 130, the lower end of the movable contact 130 is fixed by the C-ring, but the invention is not limited to this. That is, a configuration may be arranged such that a positioning large diameter portion protruding radially is formed in a C-ring position on the linking shaft 131, the contact spring 134 is disposed after the movable contact 130 abuts the positioning large diameter portion, and the upper end of the contact spring 134 is fixed by the C-ring.

Also, in the heretofore described embodiment, a description has been given of a case in which the hermetic container includes the contact housing case 102 and cap 230, and a gas is sealed in the hermetic container, but the invention not being limited to this, the gas seal may be omitted when a current to be interrupted is low.

Furthermore, in the heretofore described embodiment, a description has been given of a case in which the invention is applied to an electromagnetic contactor, but the invention, not being limited to this, can be applied to any switches including an electromagnetic relay and other electromagnetic switches.

REFERENCE SIGNS LIST

10 . . . Electromagnetic contactor, 100 . . . Contact device, 101 . . . Contact mechanism, 102 . . . Contact housing case (arc extinguishing chamber), 104 . . . Metal quadrangular cylindrical body, 105 . . . Fixed contact support insulating substrate, 111, 112 . . . Fixed contact, 114 . . . Support conductor portion, 115 . . . Contact conductor portion, 116 . . . Upper plate portion, 117 . . . Intermediate plate portion, 118 . . . Lower plate portion, 121 . . . Insulating cover, 130 . . . Movable contact, 131 . . . Linking shaft, 134 . . . Contact spring, 140 . . . Insulating cylindrical body, 200 . . . Electromagnet unit, 201 . . . Magnetic yoke, 203 . . . Round cylindrical auxiliary yoke, 204 . . . Spool, 208 . . . Exciting coil, 210 . . . Upper magnetic yoke, 210*a* . . . Through hole, 210*b* . . . Contact pole surface, 214 . . . Return spring, 215 . . . Movable plunger, 216 . . . Peripheral flange portion, 216*a* . . . Annular protruding portion, 216*b* . . . Contact pole surface, 220 . . . Circular permanent magnet, 225 . . . Auxiliary yoke

What is claimed is:

1. An electromagnetic switch, comprising:

a pair of fixed contacts fixed in a contact housing case with a predetermined distance therebetween;

a movable contact disposed in the contact housing case to contact to and separate from the pair of fixed contacts; and an electromagnet unit causing the movable contact to contact to and separate from the pair of fixed contacts, wherein the electromagnet unit has a magnetic yoke enclosing an exciting coil, a movable plunger disposed to move through a through hole provided in the magnetic yoke and having a peripheral flange portion which extends radially outwardly and a contact pole surface formed at the peripheral flange portion and facing a contact pole surface of the magnetic yoke, and a linking shaft linking the movable plunger and the movable contact, and the contact pole surface of the movable plunger includes a circular protruding portion having a width narrower than that of a surface facing the magnetic yoke for increasing a magnetic flux density.

2. The electromagnetic switch according to claim 1, wherein the circular protruding portion is formed in an annular shape.

3. An electromagnetic switch, comprising:

a pair of fixed contacts fixed in a contact housing case with a predetermined distance therebetween;

a movable contact disposed in the contact housing case to contact to and separate from the pair of fixed contacts; and an electromagnet unit causing the movable contact to contact to and separate from the pair of fixed contacts, wherein the electromagnet unit has a magnetic yoke enclosing an exciting coil, a movable plunger disposed to move through a through hole provided in the magnetic yoke and having a contact pole surface facing a contact pole surface of the magnetic yoke, and a linking shaft linking the movable plunger and the movable contact, the contact pole surface of the movable plunger includes a circular protruding portion having a width narrower than that of a surface facing the magnetic yoke for increasing a magnetic flux density, and the circular protruding portion is formed on an outer peripheral side of a peripheral flange portion formed on the movable plunger.

* * * * *